US007884546B2

(12) United States Patent
Ogasawara et al.

(10) Patent No.: US 7,884,546 B2
(45) Date of Patent: Feb. 8, 2011

(54) ELECTRODELESS DISCHARGE LAMP APPARATUS AND LIGHTING FIXTURE WITH THE ELECTRODELESS DISCHARGE LAMP APPARATUS

(75) Inventors: Hiroshi Ogasawara, Yawata (JP); Hiroshi Miyasaki, Tsubame (JP); Hidenori Kakehashi, Takatsuki (JP); Keisuke Harada, Himeji (JP); Yoshinobu Shibata, Himeji (JP)

(73) Assignees: Panasonic Electric Works Co., Ltd., Osaka (JP); Ikeda Electric Co., Ltd., Hyogo (JP)

( * ) Notice: Subject to any disclaimer, the term of this patent is extended or adjusted under 35 U.S.C. 154(b) by 300 days.

(21) Appl. No.: 12/064,730

(22) PCT Filed: Sep. 28, 2005

(86) PCT No.: PCT/JP2005/017883

§ 371 (c)(1),
(2), (4) Date: Feb. 25, 2008

(87) PCT Pub. No.: WO2007/023573

PCT Pub. Date: Mar. 1, 2007

(65) Prior Publication Data

US 2009/0146562 A1 Jun. 11, 2009

(30) Foreign Application Priority Data

Aug. 26, 2005 (JP) ..... 2005-246835

(51) Int. Cl.

| | |
|---|---|
| ***H01J 11/00*** | (2006.01) |
| ***H01J 17/00*** | (2006.01) |
| ***H01J 61/00*** | (2006.01) |
| ***H01J 61/28*** | (2006.01) |
| ***H01K 1/50*** | (2006.01) |

(52) U.S. Cl. ..... 313/567; 313/231.01; 313/31; 313/634

(58) Field of Classification Search ..... 313/491, 313/493, 234, 634, 607, 567, 231.01, 31, 313/160, 238; 315/248, 267, 283, 344
See application file for complete search history.

(56) References Cited

U.S. PATENT DOCUMENTS 5,130,912 A 7/1992 Friederichs et al.

(Continued)

FOREIGN PATENT DOCUMENTS

JP 51-101121 8/1976

(Continued)

OTHER PUBLICATIONS

English language Abstract of JP 2003-317672.

(Continued)

*Primary Examiner*—Nimeshkumar D Patel
*Assistant Examiner*—Anthony T Perry
(74) *Attorney, Agent, or Firm*—Greenblum & Bernstein, P.L.C.

(57) ABSTRACT

An electrodeless discharge lamp apparatus is provided which is increased in heat dissipation, making it possible to adapt to an increase in output of the apparatus. The electrodeless discharge lamp apparatus comprises a bulb containing a discharge gas and a coupler accommodated in a cavity formed in the bulb for generating a high frequency electromagnetic field. The coupler has: an induction coil; a core inserted into the coil; a heat conductor for conducting heat generated from the coil and the core; and a bobbin made of resin which accommodates the core and the heat conductor therein, and which has the coil wound therearound. The bobbin is designed to be separated in a radial direction of the coil, so that it is possible to separately mold the respective parts of the bobbin. Thus, it is not necessary to form, in the bobbin, a draft angle which has been necessary in the prior art when molding a tubular-shaped bobbin, and it is possible to make the thickness of the bobbin thin and uniform, so that the proportion of the bobbin in the volume of the cavity can be reduced to increase the proportion of the heat conductor.

24 Claims, 7 Drawing Sheets

U.S. PATENT DOCUMENTS

| | | | | |
|---|---|---|---|---|
| 5,801,493 | A | | 9/1998 | Antonis et al. |
| 5,834,890 | A | | 11/1998 | Girach |
| 5,903,109 | A | * | 5/1999 | Van Gennip et al. ..... 315/248 |
| 6,084,359 | A | | 7/2000 | Hetzel et al. |
| 2007/0069647 | A1 | | 3/2007 | Kakehashi et al. |
| 2007/0210727 | A1 | | 9/2007 | Sun et al. |
| 2007/0262730 | A1 | | 11/2007 | Ogasawara et al. |
| 2008/0030143 | A1 | | 2/2008 | Goriki et al. |
| 2008/0048586 | A1 | | 2/2008 | Hasegawa et al. |

FOREIGN PATENT DOCUMENTS

| | | |
|---|---|---|
| JP | 53-105076 | 9/1978 |
| JP | 54-95186 | 7/1979 |
| JP | 10-92390 | 4/1998 |
| JP | 10-92391 | 4/1998 |
| JP | 11-501152 | 1/1999 |
| JP | 2003-317672 | 11/2003 |
| JP | 2003-317673 | 11/2003 |
| KR | 198038 | 6/1999 |
| WO | 97/23895 | 7/1997 |
| WO | 2005/041245 | 5/2005 |

OTHER PUBLICATIONS

English language Abstract of JP 11-501152.
English language Abstract of JP 2003-317673.
English language Abstract of JP 53-105076.
English language Abstract of JP 10-92390.
English language Abstract of JP 10-92391.

* cited by examiner

ELECTRODELESS DISCHARGE LAMP APPARATUS AND LIGHTING FIXTURE WITH THE ELECTRODELESS DISCHARGE LAMP APPARATUS

TECHNICAL FIELD

The present invention relates to an electrodeless discharge lamp apparatus in which a discharge gas filled in a bulb is excited by a high frequency electromagnetic field to emit light, and to a lighting fixture with the electrodeless discharge lamp apparatus.

BACKGROUND ART

As shown in Published Japanese Translation of PCT Application Hei 11-501152 or the pamphlet of International Patent Publication WO 05/041245, a known electrodeless discharge lamp apparatus of this kind is the apparatus with the so-called internal winding method, which comprises a light-transmitting bulb containing a discharge gas and a high frequency electromagnetic field generator (hereafter referred to as coupler) accommodated in a cavity formed in the bulb for generating a high frequency electromagnetic field. In such apparatus, the coupler comprises: an induction coil through which a current flows to generate a high frequency electromagnetic field; a core formed of a soft magnetic material and inserted into the induction coil; a heat conductor for conducting heat generated by the induction coil and/or the core to near an inlet of a cavity; and a bobbin made of resin which accommodates and holds the core and/or the heat conductor, and around which the induction coil is wound.

Such an electrodeless discharge lamp apparatus has features that it has a long life because of having no electrode, good responsiveness when lighting, and high efficiency, so that it is suitably used e.g. in lighting fixtures for high ceilings, downlights and road lamps where maintenance is difficult.

Now, in recent years, attempts have been made in such electrodeless discharge lamp apparatus to increase the output of the apparatus, and development of an apparatus which operates with a lamp power over 200 W is desired. However, if an apparatus is operated with a lamp power over 200 W, the amount of heat generation becomes very large. Thus, it is necessary to increase the heat dissipation of the coupler accommodated in the cavity. More specifically, with an increase in the output of the apparatus, there is a risk that if the heat dissipation of the coupler is poor, the core approaches saturation when excessive heat is applied to the coupler, so that the coil may become unable to maintain stable impedance, causing unstable lighting. In addition, an increase in the output of the apparatus causes an increase in temperature of the bulb, causing an increase of stress to a fluorescent material coated on an inner surface of the bulb. Thus, if the heat dissipation of the coupler is poor, there is a risk that the light emission efficiency of the lamp may be reduced. For this reason, an increase in the heat dissipation of the coupler to suppress the temperature increase of the bulb and the coupler leads to prevention of the reduction in the light emission efficiency of the apparatus.

Note that the apparatus shown in the former of the above documents is designed so that the heat conductor occupies at least half of an outer peripheral surface of the coupler so as to increase the heat dissipation of the coupler. On the other hand, the apparatus shown in the latter document is designed so that a coil is wound on the surface of a skeleton-shaped bobbin and a core, in which the core placed in an opening formed by the skeleton is substantially surface-contacted with the heat conductor so as to increase the heat dissipation of the coupler.

DISCLOSURE OF INVENTION

Now, in a conventional electrodeless discharge lamp apparatus, a bobbin made of resin is generally molded into a tubular shape by using a die. However, as the size of the coupler increases with an increase in the output of the electrodeless discharge lamp apparatus, and the size of the bobbin increases, it is necessary, when molding a tubular-shaped bobbin, to provide the bobbin with a large draft angle. Since this causes the bobbin to increase in size radially, and since there is a limit in the diameter of the cavity, there has been a problem that the proportion of the heat conductor in the volume of the cavity decreases, consequently lowering the heat dissipation of the coupler.

Further, if a bobbin made of resin intervenes between an induction coil and a core so as to wrap the entire core therein such as in the case of using a tubular-shaped bobbin with no opening on a side surface thereof as in the electrodeless discharge lamp apparatus shown in patent document 1 (sic, correctly: the former document), then there is a problem that the heat generated from the induction coil or the periphery is blocked by the bobbin, making it difficult for the heat to be transferred to the core and the heat conductor, consequently lowering the heat dissipation of the coupler. Particularly considering the increase in the output of the electrodeless discharge lamp apparatus, which is likely to cause concentration of plasma at the periphery of the induction coil and thus increase its temperature, there is a risk that mere dissipation of the heat from the core through the heat conductor as in the prior art may cause an undesirable increase in the temperature of the periphery of the induction coil and significant reduction in the light emission efficiency.

Besides, in the case of an electrodeless discharge lamp apparatus with a lamp power over 200 W, it has been verified experimentally that it is effective to reduce the filled gas to 10 Pa as a means to increase the light emission efficiency. In this case, it is known that the starting voltage increases by about 1.5 to 2 times. Normally, an induction coil is formed by extending a winding wire along the surface of a bobbin in a direction substantially parallel to the axial direction of the induction coil, and thereafter bending the winding wire into an L-shape and winding it around the bobbin. Here, a voltage the same as the starting voltage is applied between a winding start portion, which is formed by extending the winding wire in a direction substantially parallel to the axial direction of the induction coil, and a winding portion which is formed by winding the winding wire around the bobbin. Thus, considering the increase in the output of the electrodeless discharge lamp apparatus, it is necessary to increase the insulation strength.

Note that patent document 2 (sic, correctly: the latter document) shows an example (refer to FIG. 5 of the same patent document) in which a glass cloth tape is allowed to intervene between the winding start portion and the winding portion so as to secure insulation between the winding start portion and the winding portion of the coil. It further shows an example (refer to FIGS. 8A, 8B of the same patent document) in which the height of the side wall of a groove portion formed in the bobbin to accommodate the winding start portion is increased so as to maintain a spatial distance between the winding portion (sic, correctly: winding start portion) and the winding portion of the induction coil, thereby securing insulation. However, the use of a glass cloth tape to secure insulation leads to use of a material other than the bobbin for the purpose of covering the winding start portion. This causes inferior workability in manufacturing the apparatus as well as a cost disadvantage. Furthermore, when the spatial distance between the winding start portion and the winding portion of the induction coil is maintained to secure insulation, it results in that the bobbin increases in size radially, and the proportion of the heat conductor in the volume of the cavity decreases, making it difficult to improve the heat dissipation of the coupler more effectively.

The present invention has been made in view of the foregoing, and an object thereof is to provide an electrodeless discharge lamp apparatus which is superior in heat dissipation and can achieve an increase in the output of the apparatus, and a lighting fixture with the electrodeless discharge lamp apparatus.

An electrodeless discharge lamp apparatus according to an aspect of the present invention comprises a light-transmitting bulb containing a discharge gas, and a high frequency electromagnetic field generator accommodated in a cavity formed in the bulb for generating a high frequency electromagnetic field, the high frequency electromagnetic field generator comprising:

an induction coil through which a high frequency current flows to generate a high frequency electromagnetic field;

a core formed of a soft magnetic material and inserted into the induction coil;

a heat conductor for conducting heat generated by the induction coil and/or the core to near an inlet of the cavity; and a bobbin made of resin which accommodates and holds the core and/or the heat conductor, and around which the induction coil is wound, wherein the bobbin can be separated in a radial direction of the induction coil.

According to this structure, the bobbin can be separated in a radial direction of the induction coil. This makes it possible to separately mold the respective parts of the bobbin to be separated in the radial direction. Thus, it is not necessary to form, in the bobbin, a draft angle which has been necessary in the prior art when molding a tubular-shaped bobbin, and it is possible to make the thickness of the bobbin thin and uniform. In other words, the proportion of the bobbin in the volume of the cavity can be reduced to increase the proportion of the heat conductor, so that the heat dissipation of the coupler can be improved.

Further, by designing so that a cover portion placed between the winding start portion and the winding portion covers the winding start portion, it is possible to secure a sufficient creepage distance between the winding start portion and the winding portion. Thus, the insulation strength increases, making it possible to adapt to an increase in the starting voltage due to an increase in the output of the apparatus.

Further, by allowing an end of the hook-shaped cover portion to extend in a direction opposite to a winding direction of the induction coil, the winding start portion is hooked and held by the hook-shaped cover portion when winding the winding wire around the bobbin. This makes it possible to securely fix the induction coil to the bobbin, preventing a positional offset of the induction coil.

Further, placement of a portion of the heat conductor to substantially contact the induction coil not only makes it possible to dissipate, via the heat conductor, the heat from the core similarly as in the prior art, but also makes it easier to dissipate, via the heat conductor, the heat at a periphery of the induction coil which particularly increases in temperature.

Further, by designing so that a surface of the core in contact with the heat conductor is substantially flat, it is possible to maintain the dimensional accuracy of the contact surface of the core with the heat conductor even if the core is increased in size or length with the increase in the output of the apparatus, making it possible to obtain intimate contact between the core and the heat conductor. Thus, the heat from the core can be efficiently dissipated through the heat conductor.

Furthermore, provision of the electrodeless discharge lamp apparatus, which is superior in heat dissipation and enables an increase in the output of the apparatus, makes it possible to achieve an increase in light flux of a lighting fixture, so that the number of installations thereof can be reduced as compared to the prior art, making it possible to achieve a reduction in maintenance and a reduction in resource consumption.

BEST MODE FOR CARRYING OUT THE INVENTION

Figure 1:
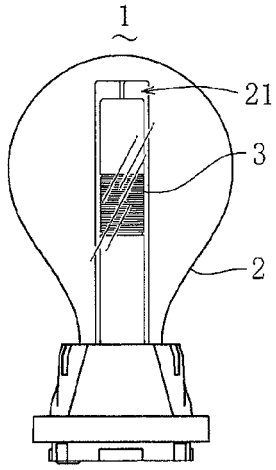
FIG. 1 is a side view of an electrodeless discharge lamp apparatus according to an embodiment of the present invention.

Hereinafter, an electrodeless discharge lamp apparatus according to an embodiment of the present invention will be described with reference to the drawings. As shown in FIG. 1, an electrodeless discharge lamp apparatus 1 comprises a light-transmitting bulb 2 containing a discharge gas and a coupler (high frequency electromagnetic field generator) separably accommodated in a cavity 21 formed in the bulb 2 for generating a high frequency electromagnetic field.

Figure 2:
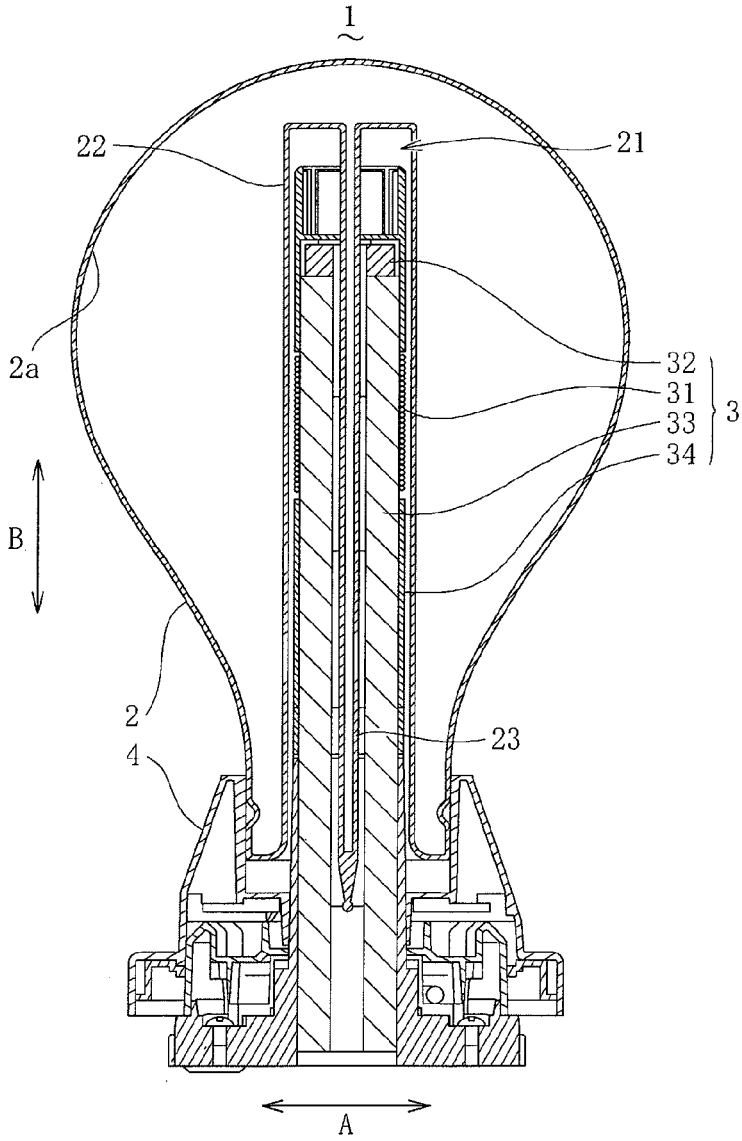
FIG. 2 is a cross-sectional view of the electrodeless discharge lamp apparatus.

As shown in FIG. 2, the bulb 2 is formed in a substantially spherical shape, and has provided therein a stem 22 forming a cavity 21 extending to the inner center thereof. Further, the bulb 2 has a gas outlet tube 23 provided in the cavity 21. The gas outlet tube 23 is used to exhaust air in the bulb 2, and fill a discharge gas such as mercury in the bulb 2, while its tube end is closed after the gas filling. Besides, a fluorescent material is coated on an inner surface 2*a* of the bulb 2. The bulb 2 emits light when ultraviolet light emitted from the discharge gas, when excited, is converted to visible light by the fluorescent material. Note that the bulb 2 is fixed and supported by a resin base member 4, while the resin base member 4 as well as the bulb 2 is separable from the coupler 3.

The coupler 3 comprises: an induction coil 31 through which a high frequency current flows to generate a high frequency electromagnetic field; cores 32 formed of a soft magnetic material and inserted into the induction coil 31; heat conductors 33 for conducting heat generated by the induction coil 31 and the cores 32 to near an inlet of the cavity 21; and a bobbin 34 made of resin which accommodates and holds the cores 32 and the heat conductors 33, and around which the induction coil 31 is wound. As will be described in detail later, the bobbin 34 is formed of two parts so that it can be separated in a radial direction of the induction coil 31. Note that in the following the radial direction of the induction coil 31 will be referred to simply as radial direction A, while the axial direction of the induction coil 31 will be referred to simply as axial direction B. As for others, the electrodeless discharge lamp apparatus 1 comprises a high frequency power supply (not shown) for supplying a high frequency current to the induction coil 31.

Note that the induction coil 31 uses e.g. a Litz wire. Its specification is a strand formed by bundling nineteen polyamide-imide wires as filaments with ϕ016 (sic, correctly: a 0.16 mm diameter), and the strand used has a fluoride insulating layer as an outer coating of the strand. By using a Litz wire, it is possible to reduce the coupler loss in a high frequency operation range. Further, the cores 32 use e.g. a Mn—Zn ferrite having good high-frequency magnetic properties. The heat conductors 33 use e.g. aluminum or copper or their alloys which have high conductivity. The bobbin 34 uses e.g. a heat resistant resin such as liquid crystal polymer, in which molding is performed using dies each having a predetermined shape for each part.

Figure 3:
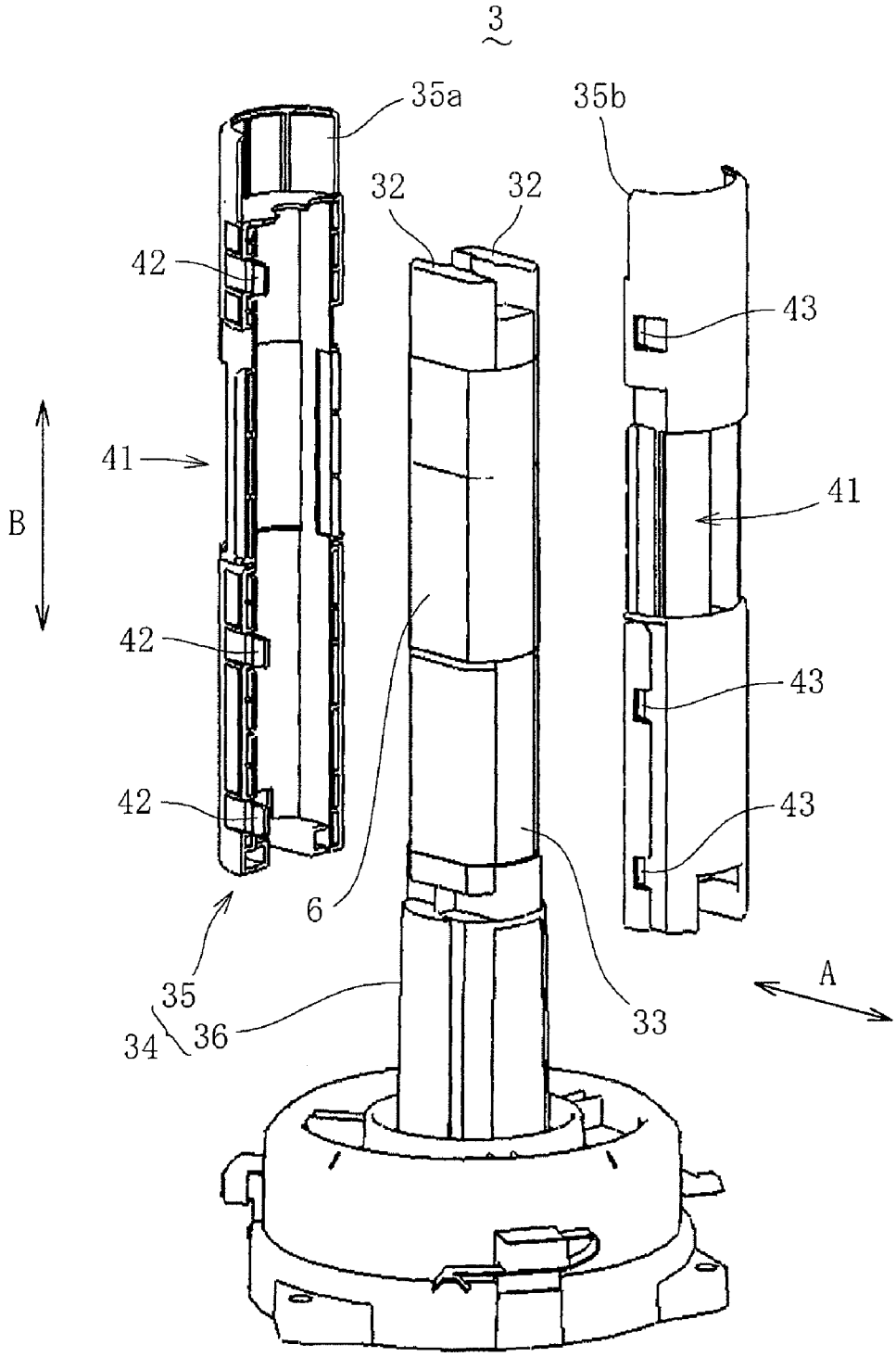
FIG. 3 is an exploded perspective view of a coupler of the electrodeless discharge lamp apparatus.
Figure 4:
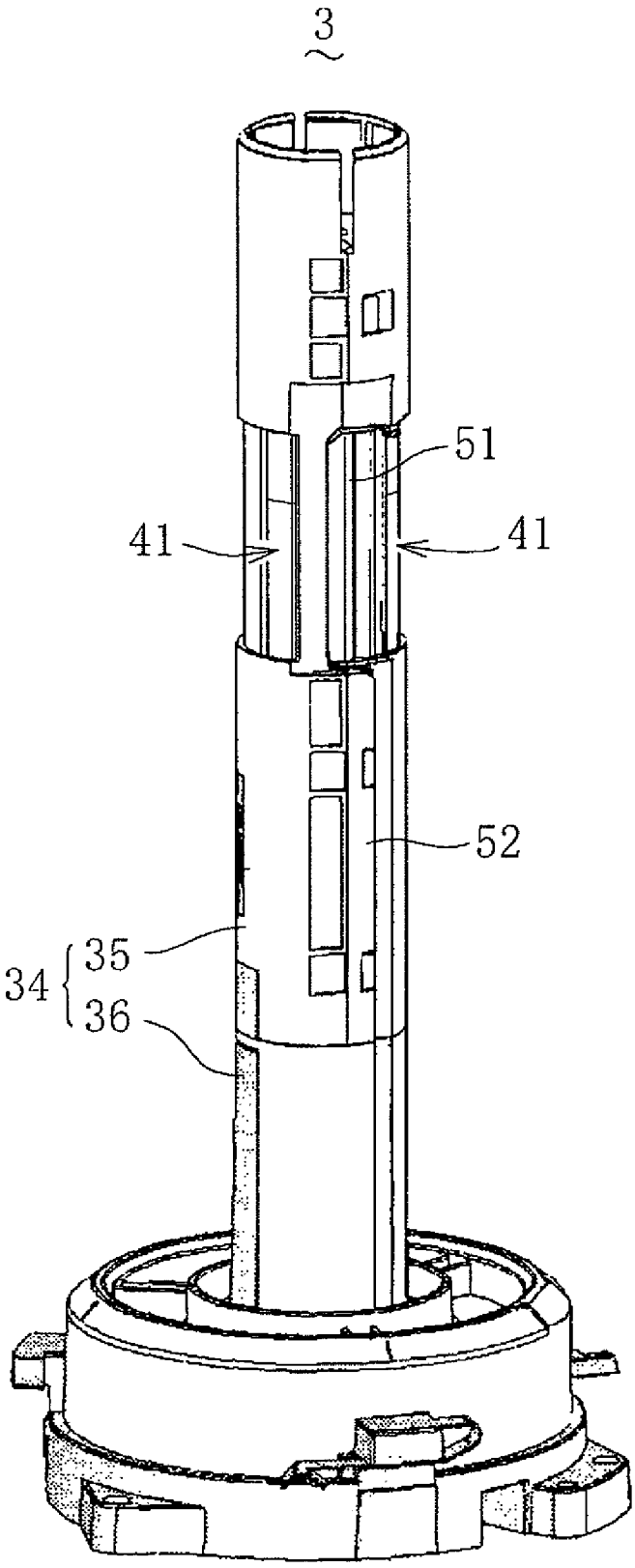
FIG. 4 is a perspective view of the coupler in a state where an inductive coil thereof is removed.
Figure 5:
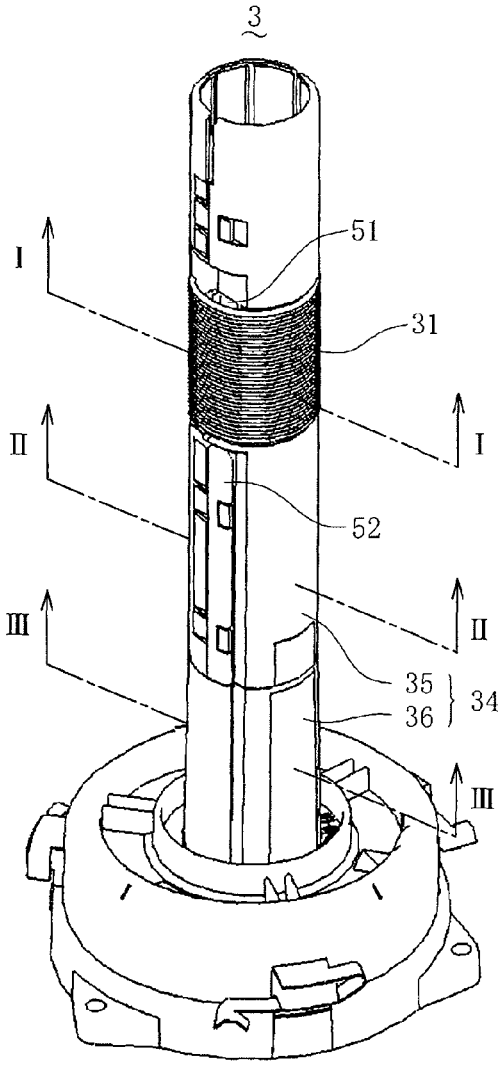
FIG. 5 is a perspective view of the coupler in a state where the inductive coil is mounted thereon.

FIG. 3, FIG. 4 and FIG. 5 respectively show the coupler 3 when separating the bobbin, the coupler 3 when assembling the bobbin, and the coupler 3 in a state where it has the induction coil 31 wound therearound. Further, FIG. 6 to FIG. 8 each show a cross-sectional view at each position of FIG. 6. As shown in FIG. 3, the bobbin 34 comprises an upper bobbin 35 and a lower bobbin 36, in which the upper bobbin 35 forms a substantial cylinder extending in the axial direction B by assembling two parts 35*a*, 35*b* which can be separated in the radial direction A. Further, each of the parts 35*a*, 35*b* has an opening portion 41 in a portion (hereafter referred to as coil mounting portion) around which the induction coil 3 is wound.

Figure 6:
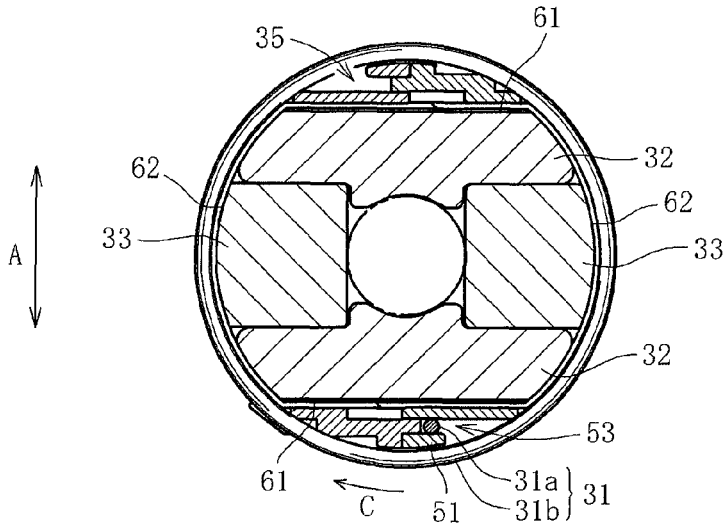
FIG. 6 is a cross-sectional view of FIG. 5 along line I-I.
Figure 7:
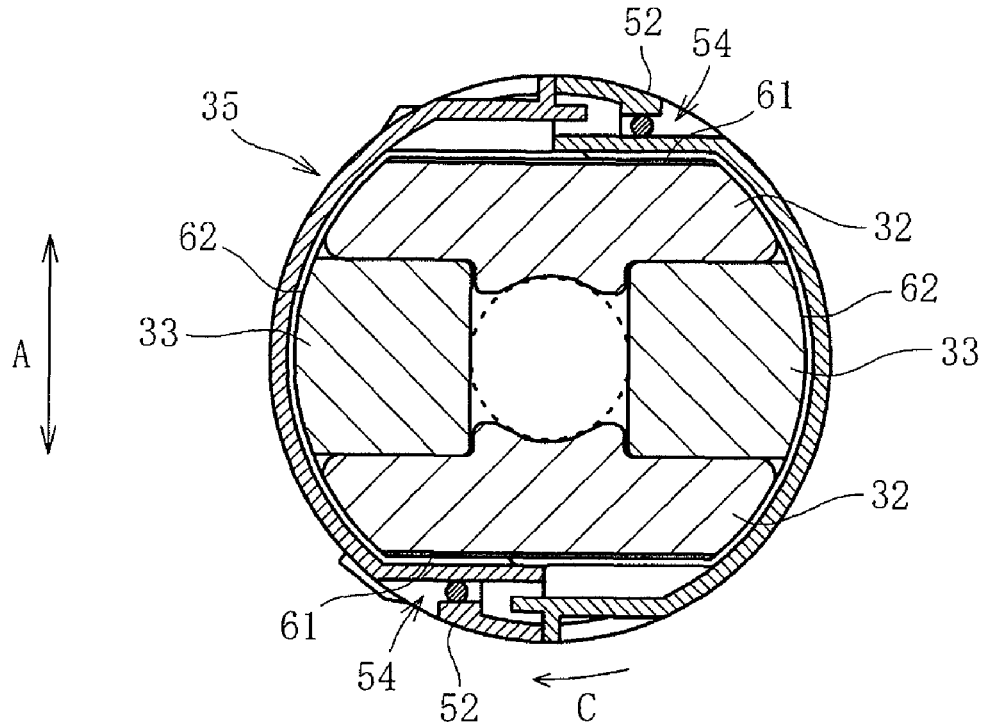
FIG. 7 is a cross-sectional view of FIG. 5 along line II-II.
Figure 8:
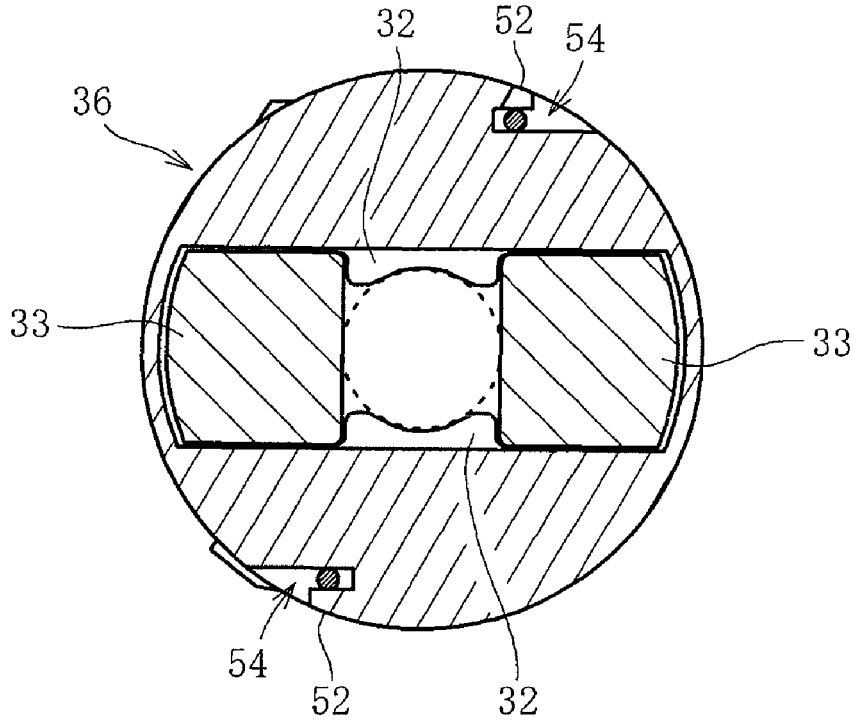
FIG. 8 is a cross-sectional view of FIG. 5 along line III-III.

As shown in FIG. 3 and the cross-sectional views of FIG. 6 to FIG. 8, the cores 32 and the heat conductors 33 are each formed in a column shape extending in the axial direction B, and are formed as a pair, respectively. The heat conductors 33 used are a pair of substantially prism-shaped ones having a cross-sectional dimension of 12 mm by 10 mm and a length of 250 mm. The material is copper. Further, the cores 32 each have a substantially trapezoidal-shaped cross section of upper 20 (lower 28) mm by 6 mm, in which three of them are connected extending in the axial direction B, while three of them (sic, correctly: two of them) are connected to form a pair in the radial direction A, six cores in total. They are placed such that the cores 32 face each other, and the heat conductors 33 face each other, while they are assembled such that a pair of cores 32 sandwich each heat conductor 33. Note that the cores 32 are each formed to be substantially flat such that the surface thereof in contact with the heat conductor 33 is substantially flat. As shown in FIG. 3, a glass cloth tape 6 is wound around a portion of these assembled cores 32 and heat conductors 33 which portion corresponds to the coil mounting portion. Further, as shown in FIG. 6 and FIG. 7, these assembled cores 32 and heat conductors 33 each have a cross section in the radial direction A which has a shape as obtained by cutting the circle near an outer periphery thereof with a pair of lines substantially parallel to each other. Note that in the following, flat portions of the assembled cores 32 and heat conductors 33 will be referred to as flat portions 61 of the assembly, while curved portions of the assembled cores 32 and heat conductors 33 will be referred to as curved portions 62 of the assembly. The curved portions 62 of the assembly are arranged to face the opening portions 41 of the bobbin 34. Furthermore, the assembled cores 32 and heat conductors 33 have formed near the center thereof a space into which the gas outlet tube 23 is inserted.

As shown in FIG. 3, the respective parts 35*a*, 35*b* of the upper bobbin 35 comprise a male-type fitting portion 42 and a female-type fitting portion 43, respectively, at positions facing each other. The coupler 3 is assembled in a manner that the fitting portions 42, 43 are fitted to each other so as to allow the respective parts 35*a*, 35*b* of the upper bobbin 35 to wrap the cores 32 and heat conductors 33 therein, in a state where the cores 32 and the heat conductors 33 are provided to stand on the lower bobbin 36, and the glass cloth tape 6 is wound around the portion corresponding to the coil mounting portion (refer to FIG. 4). Thus, in order to assemble the coupler 3, the fitting portions 42, 43 are only required to be fitted to each other so as to allow the respective parts 35*a*, 35*b* to wrap the cores 32 and heat conductors 33 therein, so that it facilitates the assembly work even if the size of the coupler 3 increases with an increase in the output of the apparatus.

Figure 9:
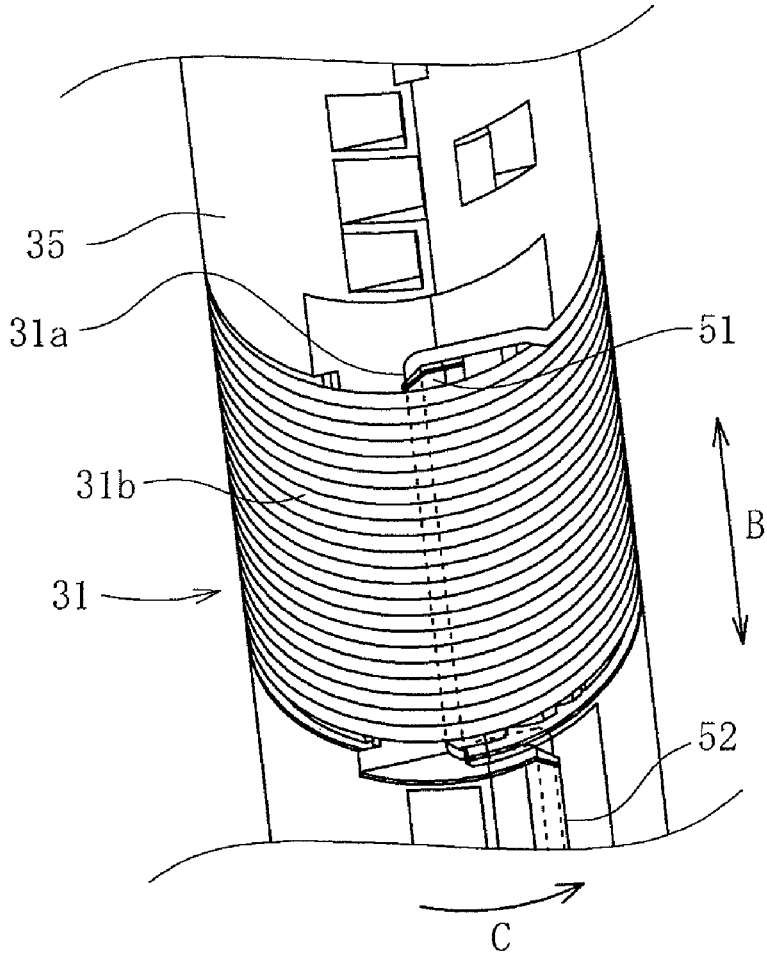
FIG. 9 is a perspective view of the coupler near the induction coil.

As shown in FIG. 6 and FIG. 9, the induction coil 31 has: a winding start portion 31*a* which is formed by extending a winding wire along the surface of the upper bobbin 35 in a direction substantially parallel to the axial direction B of the induction coil 31; and a winding portion 31*b* which is placed on an outer side in the radial direction A than the winding start portion 31*a*, and which is formed by winding the winding wire around the upper bobbin 35. As shown in FIG. 6, the upper bobbin 35 has an upper cover portion (cover portion) 51 placed at the coil mounting portion between the winding start portion 31*a* and the winding portion 31*b* so as to cover the winding start portion 31*a* of the induction coil 31. Further, as shown in FIG. 7 and FIG. 8, the upper bobbin 35 and the lower bobbin 36 have lower cover portions 52 placed lower than the coil mounting portion so as to cover the winding wire. These upper cover portion 51 and lower cover portions 52 are placed on an outer side in the radial direction A than notches 53, 54 formed substantially in parallel to the flat portions 61 of the assembly, and are formed in a hook shape so as to be able to hold the winding wire accommodated in the notches 53, 54. These notches 53, 54 as well as the upper cover portion 51 and the lower cover portions 52 are formed to extend in the axial direction B. The upper cover portion 51 is formed at a portion where the opening portions 41 of the coil mounting portion are not formed, and has a hook having an end formed to extend in a direction opposite to a winding direction C of the induction coil 31 as shown in FIG. 6. On the other hand, as shown in FIG. 7 and FIG. 8, the lower cover portion 52 has a hook having an end extending in a direction opposite to that of the upper cover portion 51 (in the same direction as the winding direction C of the induction coil), and formed at a position slightly offset from the upper cover portion 51 in the circumferential direction of the bobbin 34. Note that the lower cover portions 52 are formed as a pair, and accommodate the winding wire on the winding start side and the winding end side, respectively.

Next, a method for winding the induction coil 31 will be described. First, a winding wire is extended from below to above along the notch 54 in substantially parallel to the axial direction B, and is bent into an L-shape at an upper end of the lower cover portion 52, so as to hook the winding wire to the lower cover portion 52. Thereafter, the winding wire is placed along the circumference of the bobbin 34, and is further bent into an L-shape. The winding wire is then extended along the surface of the bobbin 34 in substantially parallel to the axial direction B so as to form a winding start portion 31*a*. Furthermore, the winding wire is bent into an L-shape at an upper end of the upper cover portion 51, and the winding wire is wound around the bobbin 34 so as to form a winding portion 31*b*. In this state, the winding portion 31*b* is placed on an outer side in the radial direction A than the winding start portion 31*a*, while the upper cover portion 51 is placed between the winding start portion 31*a* and the winding portion 31*b*. Besides, the curved portions (portions of the heat conductors) 62 of the assembly facing the opening portions 41 are placed to substantially contact the induction coil 31 only through the glass cloth tape 6.

As described in the foregoing, according to the electrodeless discharge lamp apparatus 1 of the present embodiment, the bobbin 34 can be separated in the radial direction A of the induction coil 31. This makes it possible to separately mold the respective parts 35*a*, 35*b* of the bobbin 34 to be separated in the radial direction A. Thus, it is not necessary to form, in the bobbin 34, a draft angle which has been necessary in the prior art when molding a tubular-shaped bobbin, and it is possible to make the thickness of the bobbin thin and uniform. In other words, the proportion of the bobbin 34 in the volume of the cavity 21 can be reduced to increase the proportion of the heat conductors 33, so that the heat dissipation of the coupler 3 can be improved.

Further, the winding start portion 31*a* is designed to be covered by the upper cover portion 51 placed between the winding start portion 31*a* and the winding portion 31*b* of the induction coil 31, so that it is possible to secure a sufficient creepage distance between the winding start portion 31*a* and the winding portion 31*b*. Thus, the insulation strength increases, making it possible to adapt to an increase in the starting voltage due to an increase in the output of the apparatus. Furthermore, since it is not necessary to use another material for improving the insulation strength, the proportion of the heat conductors 33 in the volume of the cavity 21 is prevented from being reduced.

Further, the hook-shaped end of the upper cover portion 51 extends in a direction opposite to the winding direction C of the induction coil 31. Thus, when winding the winding wire around the bobbin 34, the winding start portion 31*a* is hooked and held by the hook-shaped upper cover 51. This makes it possible to securely fix the induction coil 31 to the bobbin 34, preventing a positional offset of the induction coil 31.

Further, the curved portions (portions of the heat conductors) of the heat conductors 33 and the cores facing the opening portions 41 are placed to substantially contact the induction coil 31 only through the glass cloth tape 6. This not only makes it possible to dissipate, via the heat conductors 33, the heat from the cores 32 similarly as in the prior art, but also makes it easier to dissipate, via the heat conductors 33, the heat at the periphery of the induction coil 31 which particularly increases in temperature. Thus, a high light emission efficiency can be achieved even if the output of the apparatus is increased (about 90 LPW e.g. with a lamp power of 240 W).

In addition, the surfaces of the cores 32 to contact the heat conductors 33 are substantially flat, so that it is possible to maintain the dimensional accuracy of the contact surface of the cores 32 with the heat conductors 33 even if the cores 32 are increased in size or length with the increase in the output of the apparatus, making it possible to obtain intimate contact between the cores 32 and the heat conductors 33. Thus, the heat from the cores 32 can be efficiently dissipated through the heat conductors 33.

Figure 10:
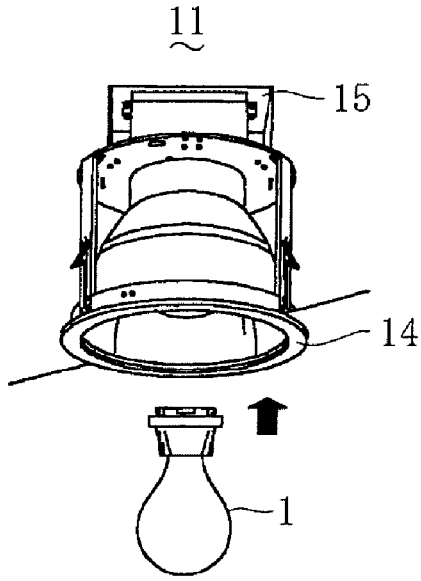
FIG. 10 is a perspective view showing an example of using the electrodeless discharge lamp apparatus.
Figure 11:
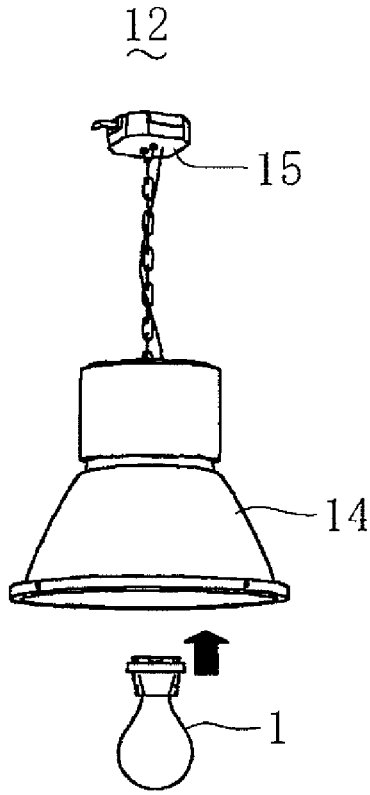
FIG. 11 is a perspective view showing an example of using the electrodeless discharge lamp apparatus.
Figure 12:
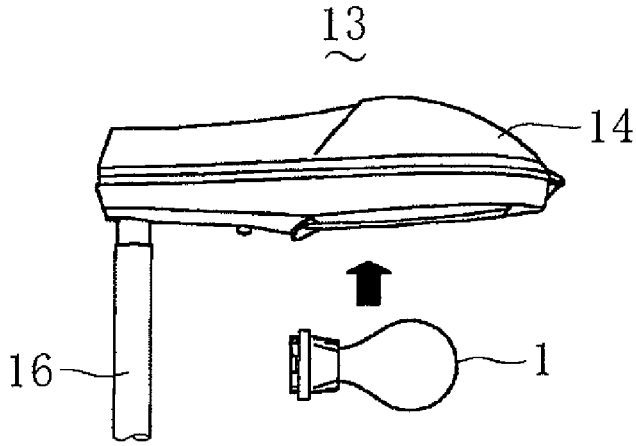
FIG. 12 is a side view showing an example of using the electrodeless discharge lamp apparatus.

FIG. 10 to FIG. 12 show examples in which the electrodeless discharge lamp apparatus 1 according to the present embodiment is incorporated in a downlight 11, a lighting fixture 12 for high ceilings, and a road lamp 13, respectively. Each of the lighting fixtures 11, 12, 13 comprises a light fitting 14 for accommodating the electrodeless discharge lamp apparatus 1. It is possible to install each light fitting 14 at a high place where maintenance is difficult, by using a fixing member 15, a support post 16, and the like. Because of the provision of the electrodeless discharge lamp apparatus 1 which is superior in heat dissipation and enables an increase in the output of the apparatus, it is possible to achieve an increase in light flux of the fixture (e.g. light flux of 22000 lm with a lamp power of about 240 W). Thus, the number of installations can be reduced as compared to the prior art, making it possible to achieve a reduction in maintenance and a reduction in resource consumption.

It is to be noted that the present invention is not limited to the embodiments described above, and various modifications are possible. For example, although the number of separations of the upper bobbin 35 is preferably two as described above, it can be three or more. Further, this application is based on Japanese patent application 2005-246835, the content of which is to be consequently incorporated into this application by reference.

The invention claimed is:

1. An electrodeless discharge lamp apparatus comprising a light-transmitting bulb containing a discharge gas, and a high frequency electromagnetic field generator accommodated in a cavity formed in the bulb for generating a high frequency electromagnetic field, the high frequency electromagnetic field generator comprising:

an induction coil through which a high frequency current flows to generate a high frequency electromagnetic field;

a core formed of a soft magnetic material and inserted into the induction coil;

a heat conductor for conducting heat generated by the induction coil and/or the core, to an inlet of the cavity; and a bobbin made of resin which accommodates and holds the core and/or the heat conductor, and around which the induction coil is wound, wherein the bobbin is separated in a longitudinal direction of the induction coil into two parts which comprise a male-type fitting portion and a female-type fitting portion interlocked with one another.

2. A lighting fixture which is provided with the electrodeless discharge lamp apparatus according to claim 1.

3. The electrodeless discharge lamp apparatus according to claim 1, wherein a surface of the core in contact with the heat conductor is substantially flat.

4. A lighting fixture which is provided with the electrodeless discharge lamp apparatus according to claim 3.

5. The electrodeless discharge lamp apparatus according to claim 1, wherein a portion of the heat conductor is placed to substantially contact the induction coil.

6. A lighting fixture which is provided with the electrodeless discharge lamp apparatus according to claim 5.

7. The electrodeless discharge lamp apparatus according to claim 5, wherein a surface of the core in contact with the heat conductor is substantially flat.

8. A lighting fixture which is provided with the electrodeless discharge lamp apparatus according to claim 7.

9. The electrodeless discharge lamp apparatus according to claim 1, wherein the induction coil has: a winding start portion which is formed by extending a winding wire along a surface of the bobbin in a direction substantially parallel to an axial direction of the induction coil; and a winding portion which is placed on an outer side of the winding start portion in the radial direction and which is formed by winding the winding wire around the bobbin, and wherein the bobbin has a cover portion placed between the winding start portion and the winding portion so as to cover the winding start portion of the induction coil.

10. A lighting fixture which is provided with the electrodeless discharge lamp apparatus according to claim 9.

11. The electrodeless discharge lamp apparatus according to claim 9, wherein a surface of the core in contact with the heat conductor is substantially flat.

12. A lighting fixture which is provided with the electrodeless discharge lamp apparatus according to claim 11.

13. The electrodeless discharge lamp apparatus according to claim 9, wherein a portion of the heat conductor is placed to substantially contact the induction coil.

14. A lighting fixture which is provided with the electrodeless discharge lamp apparatus according to claim 13.

15. The electrodeless discharge lamp apparatus according to claim 13, wherein a surface of the core in contact with the heat conductor is substantially flat.

16. A lighting fixture which is provided with the electrodeless discharge lamp apparatus according to claim 15.

17. The electrodeless discharge lamp apparatus according to claim 9, wherein the cover portion is formed in a hook shape which has an end extending in a direction opposite to a winding direction of the induction coil.

18. A lighting fixture which is provided with the electrodeless discharge lamp apparatus according to claim 17.

19. The electrodeless discharge lamp apparatus according to claim 17, wherein a surface of the core in contact with the heat conductor is substantially flat.

20. A lighting fixture which is provided with the electrodeless discharge lamp apparatus according to claim 19.

21. The electrodeless discharge lamp apparatus according to claim 17, wherein a portion of the heat conductor is placed to substantially contact the induction coil.

22. A lighting fixture which is provided with the electrodeless discharge lamp apparatus according to claim 21.

23. The electrodeless discharge lamp apparatus according to claim 21, wherein a surface of the core in contact with the heat conductor is substantially flat.

24. A lighting fixture which is provided with the electrodeless discharge lamp apparatus according to claim 23.

* * * * *